United States Patent [19]

Roux

[11] 4,273,491

[45] Jun. 16, 1981

[54] DEVICE FOR STORAGE OF FLAT OBJECTS

[75] Inventor: Jacques Roux, Paris, France

[73] Assignee: Agence Nationale de Valorisation de la Recherche (ANVAR), Neuilly-sur-Seine, France

[21] Appl. No.: 896,485

[22] Filed: Apr. 14, 1978

[30] Foreign Application Priority Data

Apr. 18, 1977 [FR] France ..... 77 11561

[51] Int. Cl.[3] ..... B65G 57/00

[52] U.S. Cl. ..... 414/109; 53/250; 193/23; 193/47; 198/416; 271/185; 271/214; 414/43; 414/108; 414/754; 414/103

[58] Field of Search ..... 414/43, 46, 47, 754, 414/103, 104, 110, 28; 53/473, 467, 447, 499, 67, 68, 76, 173, 244, 249, 250, 252; 193/17, 47, 21, 23; 198/389, 390, 400, 416; 271/185, 184, 214, 215, 207

[56] References Cited

U.S. PATENT DOCUMENTS

| | | | |
|---|---|---|---|
| 2,594,166 | 4/1952 | Hennink | 414/103 X |
| 3,425,184 | 2/1969 | Heliot | 53/244 X |
| 3,918,703 | 11/1975 | Mano et al. | 414/35 X |
| 3,934,717 | 1/1976 | Katagiri et al. | 271/185 X |
| 3,982,637 | 9/1976 | Roetgerink | 193/47 X |

FOREIGN PATENT DOCUMENTS

| | | | |
|---|---|---|---|
| 1088877 | 9/1960 | Fed. Rep. of Germany | 414/103 |
| 364367 | 1/1932 | United Kingdom | 414/109 |

OTHER PUBLICATIONS

IBM Technical Disclosure Bulletin-vol. 16, No. 11, (Apr. 1974), pp. 3535-3537.

*Primary Examiner*—Frank E. Werner
*Attorney, Agent, or Firm*—Darby & Darby

[57] ABSTRACT

Apparatus for stacking and storing a plurality of flat objects, such as letters. The apparatus includes at least one storage box and a loading device designed to transport the flat objects from a source and to project them into the interior of the box. The box and loading device are respectively positioned so that the flat objects are projected into the box at an incline with respect to its bottom and a portion of each object's leading edge impacts a stopping surface formed in one of the side walls of the box. This impact imparts a rotational couple to the object which brings the lower edge of the object into firm engagement with the box bottom. The object is then moved onto the stack of similar objects being formed in the box, either by gravity or an auxiliary device. In one preferred embodiment, relative movement is provided between the box and loading device so that the objects can be projected into the box at a point close to the top of the stack. Other embodiments provide for automatic feed of boxes past the loading device so that loading can be performed continuously.

16 Claims, 13 Drawing Figures

A
3
$V_0$
2
4
5
1b
α
1
1a
G
I
V
r

DEVICE FOR STORAGE OF FLAT OBJECTS

The present invention relates to the storage of flat objects arriving at a storage point, individually or in groups of several, the successively arriving units or groups overlapping, partially or not.

In known devices the storage is accomplished in two operations. The flat objects are stacked on a receiving platform, and the stack formed is then seized itself, usually by hand, and placed in a box.

Under these conditions, the storage time is considerable.

The device according to the invention makes it possible to eliminate the operation of formation of the stack. As a matter of fact, in the present invention, the objects arriving are sent directly into the box containing them.

In the remainder of this text, the word "flat object" must be understood to mean either a single object or a group of several flat objects, the said flat objects thus comprised arriving successively one behind the other, partially overlapping or spaced from one another.

Thus, the flat object can be a flat object strictly speaking, or a group of two flat objects, strictly speaking, totally or partially one against the other, or a group of several flat objects strictly speaking, overlapping in the same manner, partially or totally. The number of flat objects which can form a group is limited only by the dimensions of the loading means, as will be seen below.

In order to achieve this object, loading means are provided, which project the flat object against the inner face, called the surface of impact, of a lateral wall of the box, in an incident direction selected in such a way as to create, on the object, during the impact of its front edge, a rotation couple which drops its lower edge firmly on the bottom of the box.

According to a first embodiment of the invention, the box is disposed in such a way that its longitudinal axis is inclined to the horizontal, and the loading means for the flat objects are situated in the vicinity of the upper part of the box in such a way that each flat object, as soon as its lower edge is dropped firmly on the bottom of the box, will place itself by simple gravity in the stack already formed.

With a box of medium or great length, the flat object, as soon as its lower edge is dropped firmly on the bottom of the box, cannot execute a sizeable translation without falling flat on the bottom of the box.

For this reason, in another embodiment of the invention, with a box of medium or great length, whether or not inclined to the horizontal, supplementary means are provided which, when the object is dropped firmly on the bottom of the box with its lower edge, urge the latter against the stack already formed, these means preferably being jets of air directed along the horizontal axis of the box against the supporting face of the stack.

Preferably, with a box of medium or great length, I incline the box longitudinally with respect to the horizontal and means are provided to furnish a relative movement between the box and the loading means along the longitudinal axis of the box, which is the direction of stacking.

Thus, according to a first embodiment with relative movement between the box and the loading means, the loadng means for the flat objects are mounted movably for translation in such a way as to feed the box at different levels of stacking along the length of the box.

In known fashion, the loading means will preferably be connected rigidly to the mobile rod of a double-action jack, extending or retracting along an axis parallel to the length of the box.

As an alternative, the loading means of the flat object will, in judicious fashion, be mounted for rotation around a point far enough away from the box to "sweep" the surface of the box in a quasi-translation.

According to a second embodiment, with relative movement between the box and the loading means, the loading means are fixed and the box moves in a translation in the direction of its longitudinal axis or axis of stacking.

Preferably, the box will move by simple gravity on an inclined surface with respect to the fixed loading means of the flat objects, the descending movement of the said box being caused by the retraction of the rod of a double-action driving jack forming a stop of the movement or descent.

In judicious fashion, I cause the box to pivot slightly around its longitudinal axis, which itself, may be inclined or not to the horizontal, in such a way that the lower longitudinal edge corresponding to the surface of impact will be situated lower than the opposite lower longitudinal edge, the surface of impact then constituting a surface of alignment of the flat objects. We can likewise carry out a reverse rotation, the said opposite edge then being the one situated the lowest.

Preferably, the loading means are constituted by a guide ramp, inclined with respect to the surface of the box receiving the impact of the flat object.

In a preferred embodiment of the invention, the ramp is a hollow tube of rectangular cross-section, with dimensions slightly larger than those of the objects stored, and which, in its part situated directly above the box, is open in the direction of the box and is pierced on a lateral face. When it is a question of groups of objects as defined above, we will select a dimension slightly larger than the thickness of the group of objects.

Furthermore, the device of the invention is very particularly adapted to rectangular, flat objects such as letters or postal cards which are to be stored after a sorting operation.

In this case, the loading means are directed in such a way as to launch the letter or postal card against the inner face of the lateral wall of the box facing the outlet of the loading means at an angle of incidence which is not zero and less than 45°.

According to an alternative embodiment, we can likewise incline the inner face of the lateral wall receiving the impact of the letters or postal cards to diminish, thereby, the inclination of the loading means to the plane of the box.

The invention also includes, preferably, an automatic drive for the advancement of the loading means with respect to the fixed box, or of the box with respect to the said fixed means, with the aid of a filling detector cooperating with position detectors, of known type, corresponding to various filled levels in the box.

The invention can likewise be used in an automatic installation of stacking and storage in boxes by the provision of other piston detectors and means of displacement such as jacks to bring the boxes one after the other in front of loading means for flat objects which fill each box in turn.

Other advantages and characteristics of the invention will appear in the description below of non-limiting examples of embodiment of the object of the invention and of the attached drawing in which.

Figure 3:
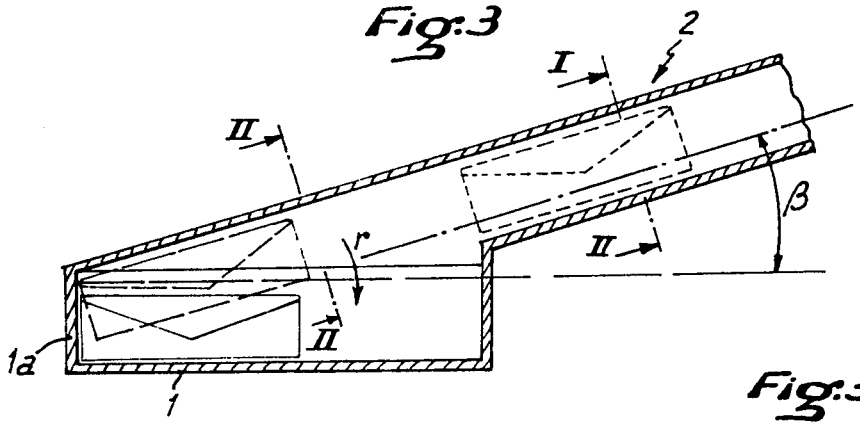
FIG. 3 is a view in longitudinal section of the same device.
Figure 3A:
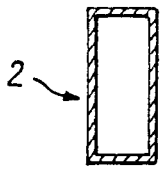
Figure 3B:
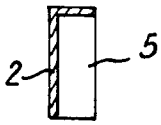
Figure 4:
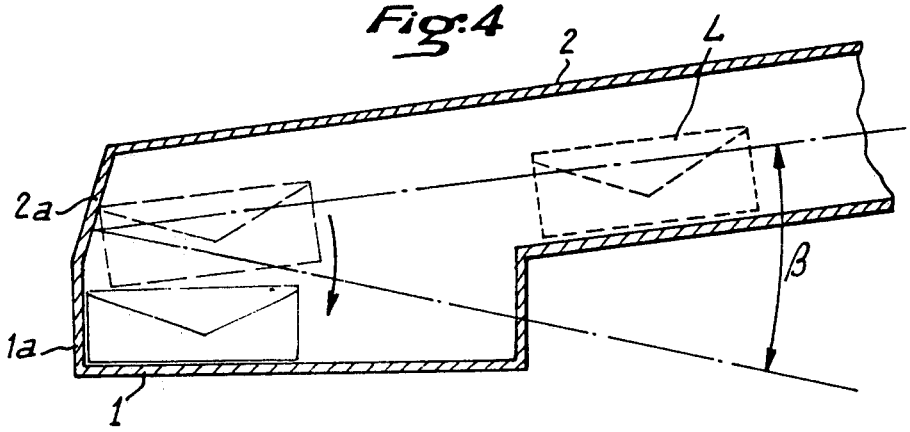
Figure 5:
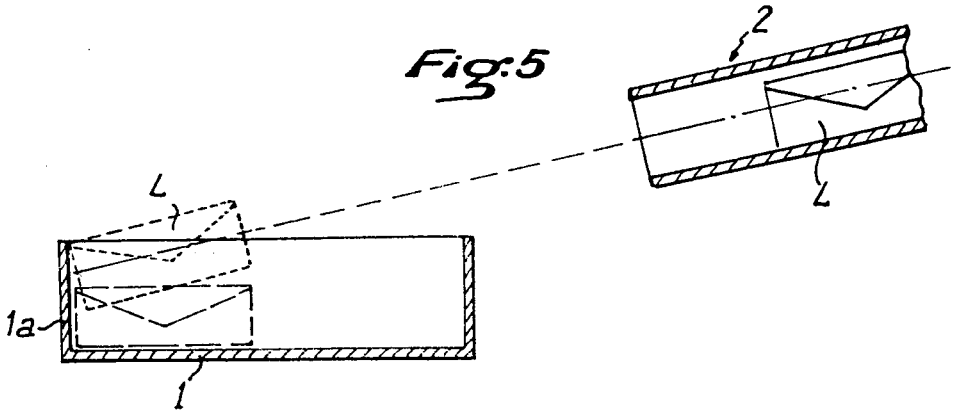
Figure 6:
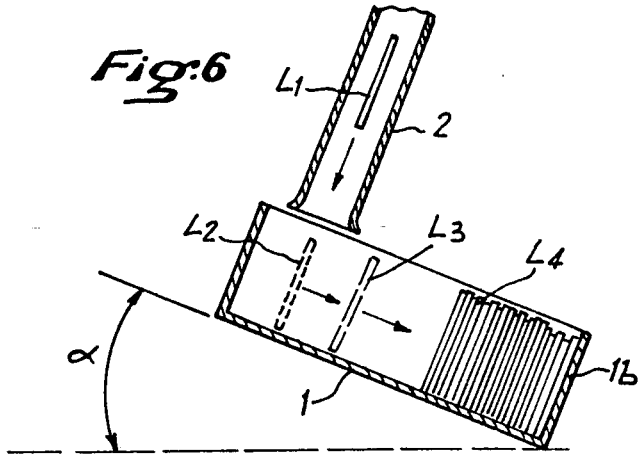
Figure 7:
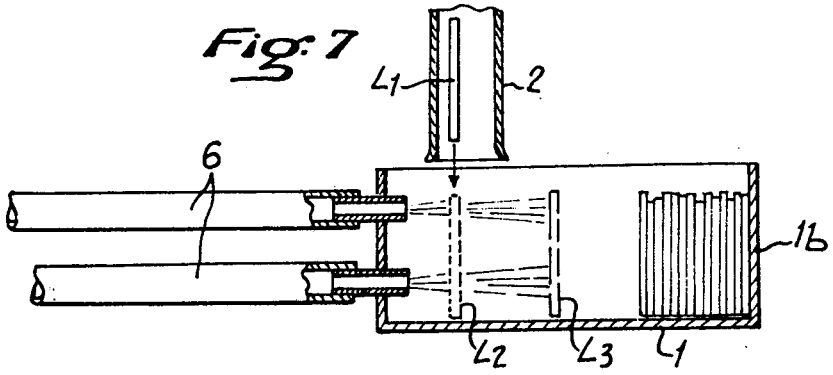
Figure 8:
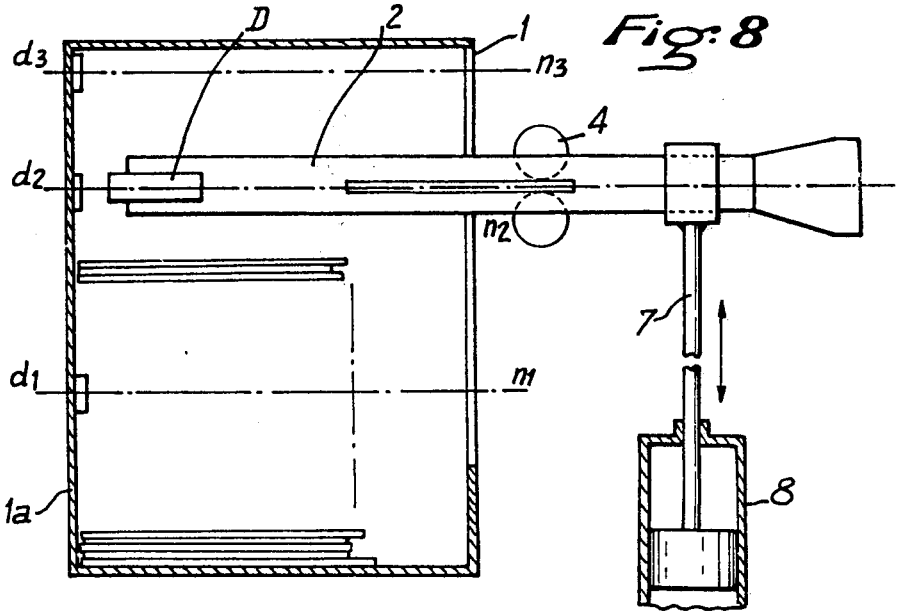

FIGS. 3*a* and 3*b* are views in cross section of the device respectively along line I—I, and II—II, in FIG. 3;

FIG. 4 illustrates a first alternative of execution of the loader of flat objects;

FIG. 5 is another alternative of execution with loading means of flat objects which means do not reach the box;

FIG. 6 illustrates the operating principle of the device with a box of short length;

FIG. 7 is a view in section of another alternative of execution with supplementary blowing means;

FIG. 8 is an overhead view of an embodiment of the device with a means for translating the loading means.

Figure 9:
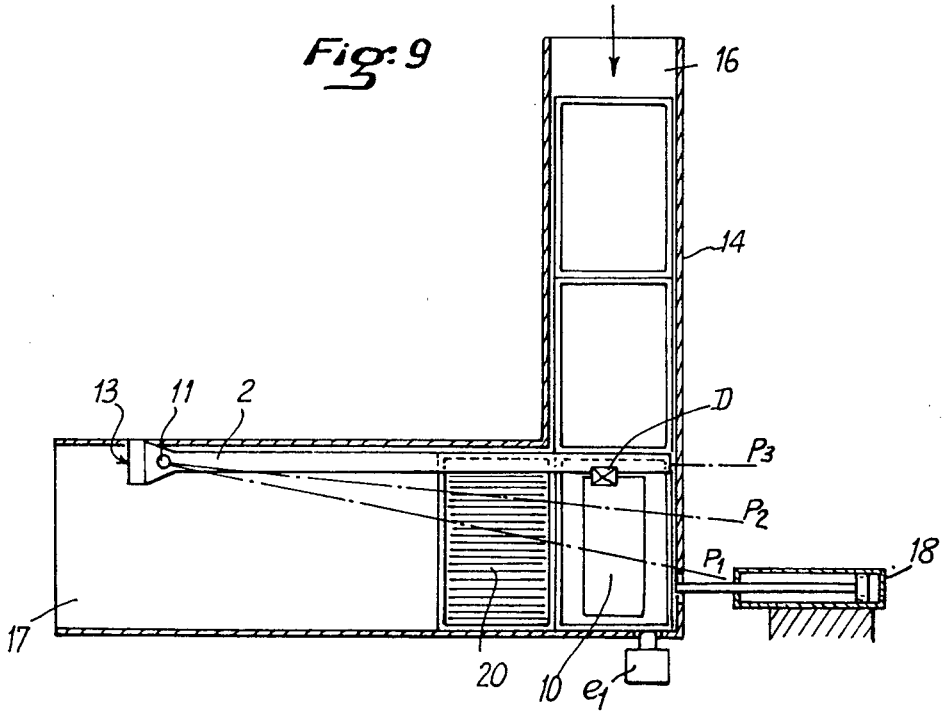
Figure 10:
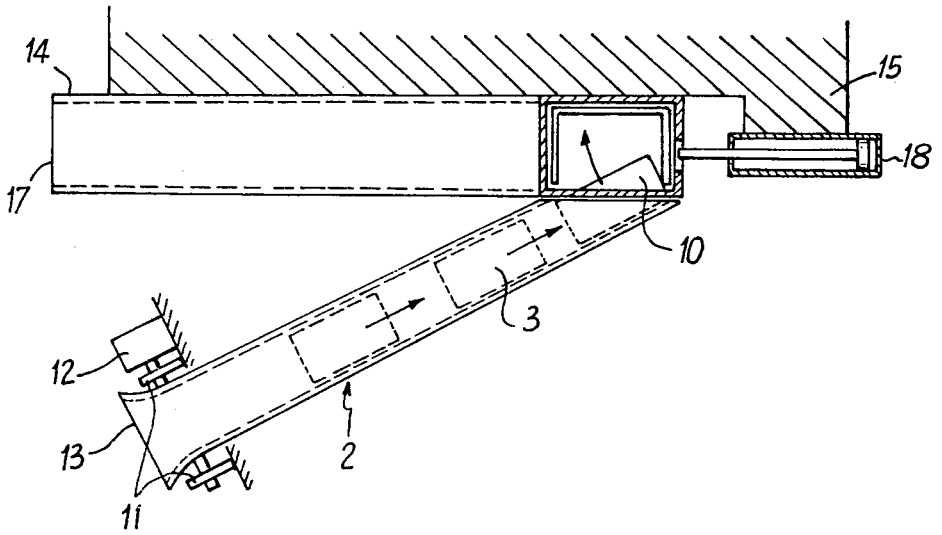

FIGS. 9 and 10 illustrate a first means of execution of the device working automatically and continuously.

Figure 11:
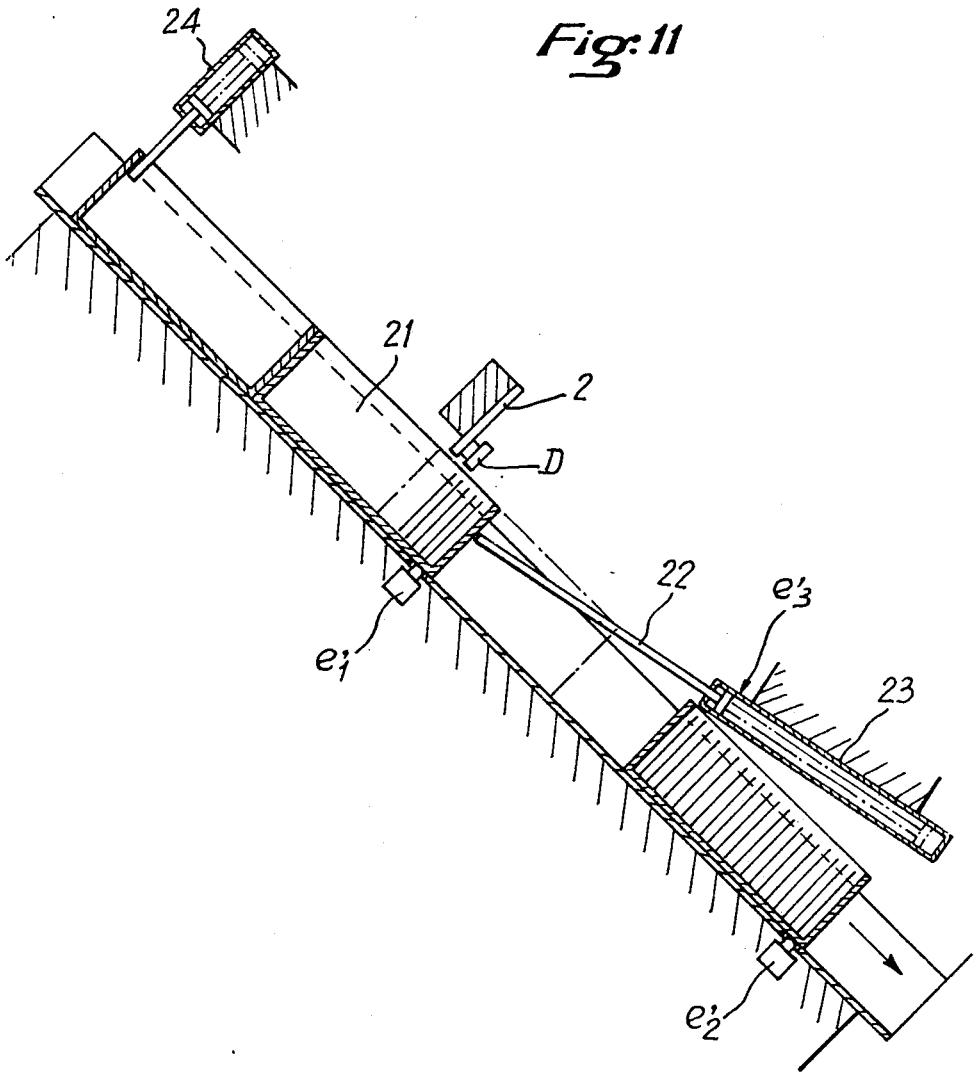

FIG. 11 illustrates a second means of execution of the device working automatically and continuously.

Figures 1, 2:
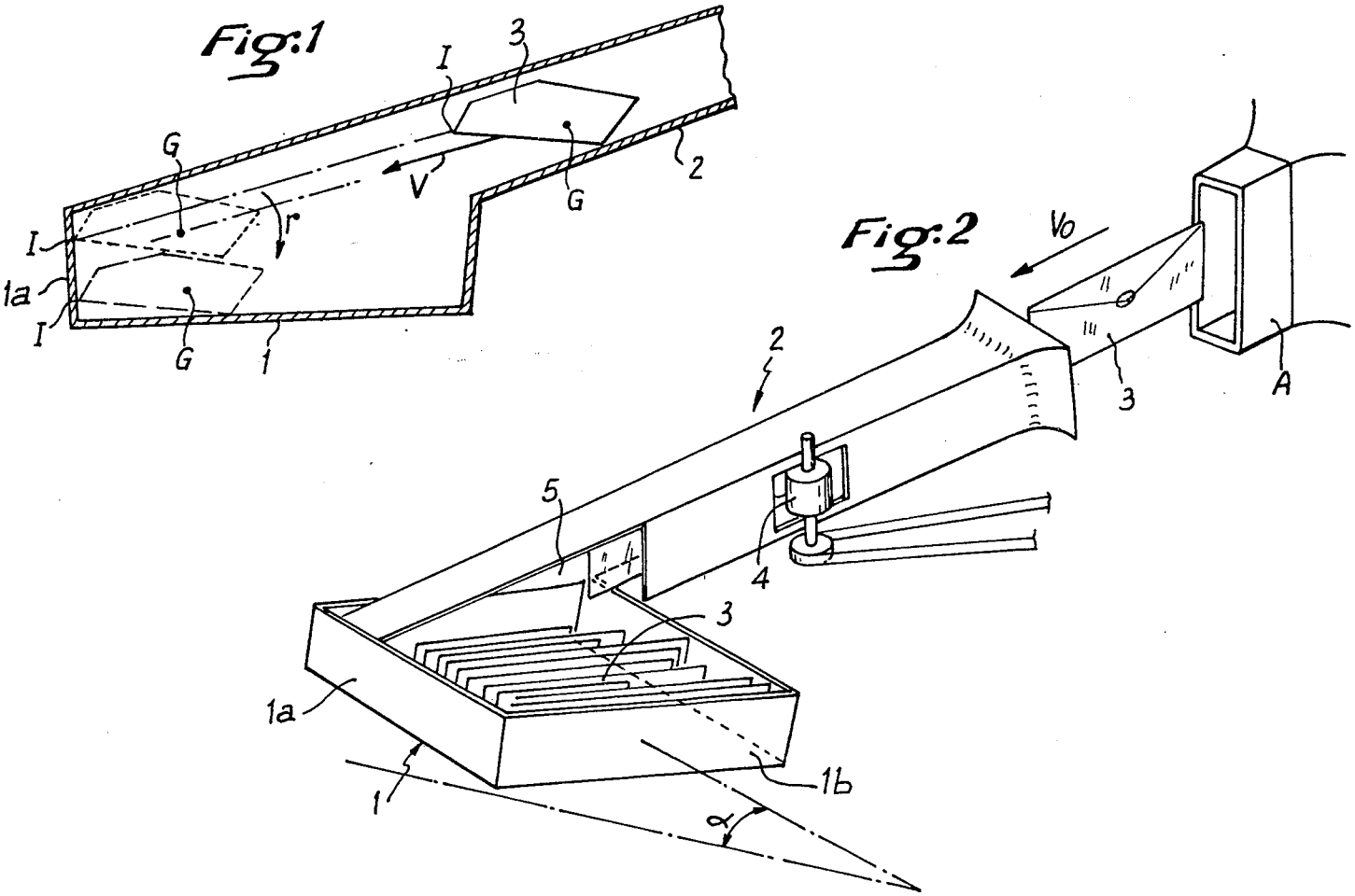
FIG. 1 illustrates the operating principle of the invention.
FIG. 2 is a diagrammatic perspective view of the device of the invention for rectangular, flat objects such as letters or postal cards.

In FIG. 1, a diagrammatic section of the device illustrates the operating principle of the invention described here.

Flat objects 3, of any form, arrive according to one of the means defined above at the open upper part of a box 1 by means of a loader 2 designated more generally heretofore in the text by the expression "loading means" and constituted here by a profile piece supporting and guiding in orientation the flat object 3 in its rectilinear movement (see FIG. 1 in long dashes) in the direction indicated by arrow V at a certain speed, which can be modified or sustained along the path inside the loading means, as we will see below. The flat objects arrive in the box from a processing machine, not shown, for the said objects situated upstream from the loader 2.

Loader 2 is inclined to the normal to the plane of the lateral wall 1*a* in an incident direction chosen in such a way that the flat object to be stored, when projected so that its front edge strikes the inner surface called the surface of impact, of this lateral wall, will receive at the moment of this impact, a couple of rotation, marked r, which drops its lower edge firmly on the bottom of the box (see FIG. 1, the flat object in short dashes at the moment of impact, then in fine, continuous lines at the moment of dropping firmly on the bottom of the box). Then, since the box has a longitudinal axis inclined with respect to the horizontal, the flat object translates on its lower edge to place itself in a stack. The speed of impact should be sufficient so that the flat object will not fall into the box without striking the surface of impact.

Likewise, the form of the objects to be stored will condition the inclination selected for the loading means. It is necessary that a couple of rotations arise on the flat object at the moment of the impact of its front edge. For this, the point of impact, marked I, of the object must be situated above the extended trajectory of the center of gravity G of the flat object.

If point I is situated on the extended trajectory, the couple is then zero and the flat object will fall to the bottom of the box by simple gravity with no effect of being dropped firmly by its lower edge and has little chance of staying on its lower edge until stacking takes place.

The invention is of particular interest for rectangular flat objects such as letters or postal cards. The invention then interevenes after the sorting operation, at the moment of storage.

In FIG. 2, we have shown, likewise in diagrammatic fashion, the elements of such a device applied to the storage of letters or postal cards, or articles of similar form.

The letters, for example, issue from the postal sorting machine, not shown, but symbolized by an outlet A, at a certain speed which is the initial speed in loader 2, marked $V_O$. This speed can be sufficient to obtain with certainty the impact of the letter on the face 1*a* of the box. In the general case, this speed is insufficient, and means of entrainment are provided to sustain a sufficient speed of the letters in the loader 2, such as endless drive belts or drive rollers as represented here at 4.

The box is inclined longitudinally with respect to the horizontal by an angular value alpha in such a way that the flat object standing on its lower edge at the bottom of the box will slide by gravity on this lower edge without falling flat and will meet the other stacked flat objects on the supporting face 1*b* (see FIG. 2) of the stack.

In FIG. 3 we have shown, in longitudinal section, the loader 2 debouching at the top of box 1 for the storage of rectangular flat objects, such as letters or postal cards. A letter L is represented in short dashes in loader 2, then in long dashes at the moment of impact of the latter on lateral wall 1*a*, and finally in upright position at the bottom of the box in fine lines. As in FIG. 2, the longitudinal axis of the box is inclined with respect to the horizontal.

The angle beta of inclination of the loading means 2, with respect to the normal to the lateral wall 1*a* of the box, should not be zero so that a couple of rotation r will form, nor should it be larger than 45° in order to avoid a sliding without rotation of the flat object on the surface of impact. Preferably, this angle will be in the vicinity of 30°.

The end of the loader situated directly above box 1 is perforated at 5 (see FIG. 2, and on the section of FIG. 3*b*).

According to a slight variation of execution shown in FIG. 4, the surface of impact 2*a* is situated at the end of the loader, contiguous to and inclined to the lateral wall 1*a* of box 1. This arrangement makes it possible to diminish the inclination of loader 2 with respect to the bottom of box 1 in certain applications.

In FIG. 5, we have shown an example of a loader 2 which does not extend above the box. The letter L or more generally, the flat object, is projected against the surface of impact, and the stacking takes place according to the principle set forth above.

FIG. 6 is a view in section along the longitudinal axis of box 1, showing the inclination alpha thereof to the horizontal, and the flat object about to arrive in the box ($L_1$) then dropping firmly on the bottom of the box ($L_2$), then sliding by gravity on its lower edge ($L_3$) then stored ($L_4$) in the stack. In this example of embodiment, the loading means 2 are fixed. Their operation is insured only for a short length of box. For longer boxes, the distance to be travelled by sliding on the bottom of the box would be too great to prevent the object from falling flat on the bottom of the box.

To remedy this, in the example in FIG. 7, supplementary means are provided, for example, blowing means 6 which keep the object upright on the bottom of the box, and accelerate its dropping against the stack already formed. We can also, in more judicious fashion, load the box 1 at several loading levels distributed along the length of the box, and marked, in the drawing in FIG. 8, respectively $n_1$, $n_2$ and $n_3$ in non-limiting fashion because it is quite obvious that we can select a different number of loading levels.

Loader 2 is displaceable in translation along the longitudinal axis of the box by means of any mechanical, hydraulic, pneumatic, or electric mechanism of appropriate type known in itself. In FIG. 8 we have shown, in non-limiting fashion, such a hydraulic system by means of a drive bar 7 constituted by the mobile rod of double-action piston 8.

For the drive of the piston, I utilize, in known fashion, a system of position detectors $d_1$, $d_2$, $d_3$, each one corresponding to a loading level, and on another, mobile, detector D, rigidly fixed to the loader and scanning the stack already formed, then advancing the loader one step (the step being the length comprised between two successive detectors).

We can substitute, for the movement of translation of the loader, an ample movement of rotation around a point sufficiently distant from the box to have a displacement of the loader close to the translation above the box.

The drawing, in FIGS. 9 to 11, represents devices according to the invention described above, which are useful for continuous and automatic storage.

FIGS. 9 and 10 illustrate a first example of continuous, automatic, storage operation according to the principle of the invention.

According to this example, the box, when filled, is displaced to bring the next box into position for the start of loading. With this in mind, there is a guide for the path of the boxes and a drive for the movement of the train which they form in this guide.

In FIG. 9, which is an elevational view, the box in loading position is the one situated at the position marked 10. The box is situated in a vertical plane, like the assembly of the guide 14 of the box positioned on a fixed support marked 15. The path has the form of an elbow with a vertical arrival at 16 and a horizontal output of the boxes marked at 17. The movement of advancement of the boxes takes place by simple gravity when the box situated at point 10 is pushed toward outlet 17 by the rod of a piston 18, for example.

The box is loaded according to the principle and the devices set forth above, in correspondence with FIGS. 1 to 8.

The loader 2 is mounted on pivots 11 (see FIG. 10 which is a plan view), and moves in rotation in the vertical plane.

A box can be loaded, for example, by means of two successive displacements in rotation of a loader 2, as shown in FIG. 9, by positions $P_1$ start of filling, $P_2$ intermediate, and $P_3$ end of filling. At the beginning, loader 2 is in filling position $P_1$ (shown in short dashes in FIG. 9).

A position detector $e_1$ is excited by the positioning of the box at the bottom of guide 14, that is to say, by the positioning of the box in space marked 10. Detector $e_1$ triggers the start of the filling, the objects entering loading 2 by the feed 13 of the said loader, are stacked in the box according to the principle disclosed above.

The first phase of the filling is conducted until the moment when detector D fixed to loader 2 detects the presence of flat objects at the level of the position corresponding to position marked $P_1$. This triggers a rotation of loader 2, which rotation is obtained by means of a step motor 12, for example.

In this manner the filling obtained is carried out up to position $P_2$, then $P_3$ (end of filling). Detector D is then excited and causes the displacement of the rod of jack 18 which pushes the box in the position marked 20, then the rod of the jack returns to its original position, the next box falls by gravity into the position marked 10, once more triggering detector $e_1$ for a fresh cycle.

In FIG. 11, another example of continuous operation is given.

The boxes in this case move in a train along an inclined plane, by simple gravity. The operation is as follows:

The box 21 to be filled arrives by gravity into position for the start of filling in front of loader 2, against a stop formed by the rod 22 of a double-acting jack 23. A position detector $d'_1$ is excited and triggers the start of the automatic loading.

The filling takes place in the same manner as in the preceding example, and in accordance with the principle set forth above.

It can be a matter of a loading with one or more relative positions of loader 2 with respect to box 21. With this in mind. there can be provided, in the same way as before, a detector D on loader 2, cooperating with the start, intermediate, and end-of-filling position detectors. These detectors are not shown.

The relative positions between the loader and the box are obtained by retraction of rod 22 of the jack, that is to say, by gradual slidings of box 21 on the inclined plane.

When the loading of the box is complete, the evacuation of the latter is achieved quite simply by the escapement of the end of jack rod 22. This is obtained by an appropriate disposition of the jack with respect to the guide path of the boxes.

In its passage, the box excites position detector $e'_2$ which drives jack rod 22 into its original position.

Detector $e'_3$ is excited by the return of jack rod 22 and causes the lifting of the rod of jack 24 serving as a retractable stop. The lifting of the rod of this jack releases the next box which abuts against rod 22 of the positioning jack, thereby permitting the start of a fresh cycle.

Although preferred embodiments of the invention have been disclosed for illustrative purposes, it will be appreciated by those skilled in the art that many additions, modifications and substitutions are possible without departing from the scope and spirit of the invention as defined in the accompanying claims.

What is claimed is:

1. In a device for forming and storing a stack of flat objects each having a plurality of edges, in a box open on one face, closed on the opposite face, and having a plurality of additional faces extending between said opposite and open faces to define sides, said flat objects being stacked substantially perpendicularly to said opposite face and against one of said sides defining a stacking surface, said objects arriving individually from a processing device in a substantially vertical plane substantially perpendicular to said opposite face and an adjacent side, and remote from said stacking surface and at a certain speed, the improvement comprising:

said box being positioned with respect to said processing device so that objects arrive along a path of travel forming an acute angle with said opposite face;

a stop situated substantially in the plane of said adjacent side of the box and positioned to receive the impact of part of the leading edge of an arriving object, said stop acting on said object to create a couple of rotation in its plane, so that an edge of said object directed towards said opposite face and defining a lower edge is urged against the opposite face of the box; and said processing device being situated at a sufficient height with respect to said opposite face so that each flat object, as soon as its lower edge is resting on said opposite face retains its perpendicular orientation thereto and moves against the stack already formed.

2. A storing device according to claim 1 and further comprising supplementary means for urging the flat object, as soon as the latter is dropped firmly in the box, against the stack already formed, said urging means acting along an axis of the box directed towards the face of the box supporting the stack.

3. A storing device according to claim 2, wherein said urging means include a blowing nozzle directed against the supporting face of the stack.

4. A storing device according to claim 1, wherein the processing device for the flat objects is mounted for translation with respect to said box and acts to feed the box at different stacking levels distributed along the length of the box.

5. A storing device according to claim 4, further comprising means for displacing the processing device for the flat objects including a double-action jack having a mobile rod connected to said processing and/or conveyor device.

6. A storing device according to claim 1, wherein the processing device for the flat objects is mounted for rotation around a point relatively distant from the box, to "sweep" the storage surface of the latter.

7. A storing device according to claim 1, wherein the box has a longitudinal axis inclined with respect to the the horizontal.

8. A storing device according to claim 7, further including an inclined plane, said box being supported on the inclined plane and moving along said plane under the influence of gravity and passing in front of the processing device for the flat objects, said processing device remaining stationary, and a rod acting to retain the box against movement down said plane, said box descending by the retraction of the rod.

9. A storing device according to any one of claims 4 to 8, including an automatic drive for the advancement of one of said processing device and said box with respect to the other, comprising detectors of position at various filling levels of the box, and a filling detector mounted at a point on said processing device from which said objects are projected and cooperating with said first detectors.

10. A storing device according to either of claims 2 or 7, wherein the box is slightly tilted around its longitudinal axis so that one of its longitudinal edges is situated at a level lower than the other, the lowest edge constituting a surface of alignment of the flat objects.

11. A storing device according to claim 1, wherein the processing device for the flat objects comprises a guide ramp inclined with respect to the side of the box in which said stop is situated, said ramp including at least one supporting surface for the flat objects, a guide surface for the objects in their movement, and a means for entrainment of the flat objects.

12. A storing device according to claim 1, designed in particular for the stacking of flat objects which are substantially rectangular wherein the processing device is positioned to launch the objects against an opposed side at an angle of incidence between 0° and 45°.

13. A storing device according to claim 12, wherein the angle of incidence is between 20° and 35°.

14. A storing device according to claim 12, including a surface of impact corresponding to the inner surface of a wall of the processing device, said wall being situated at the end of the said processing device directed toward the box, the normal to this wall forming, with the direction of the arriving objects, an angle approximately between 0° and 45°.

15. A storing device according to claim 1, wherein the stop is the inner face of a wall of the processing device for the flat objects, the normal to this wall forming, with the direction of the arriving objects, an angle substantially equal to 45°.

16. A storing device according to claim 1, where the said stop is constituted by the edge of the box situated opposite the processing device.

* * * * *